US008602273B2

(12) United States Patent
Carter et al.

(10) Patent No.: US 8,602,273 B2
(45) Date of Patent: Dec. 10, 2013

(54) SAFETY CAN

(75) Inventors: Glen A. Carter, Mattoon, IL (US); Mark T. Goddard, Charleston, IL (US)

(73) Assignee: Justrite Manufacturing Company LLC, Des Plaines, IL (US)

( * ) Notice: Subject to any disclaimer, the term of this patent is extended or adjusted under 35 U.S.C. 154(b) by 172 days.

(21) Appl. No.: 13/038,211

(22) Filed: Mar. 1, 2011

(65) Prior Publication Data

US 2012/0048895 A1 Mar. 1, 2012

Related U.S. Application Data

(60) Provisional application No. 61/309,345, filed on Mar. 1, 2010.

(51) Int. Cl.

| | |
|---|---|
| ***B65D 47/08*** | (2006.01) |
| ***A47G 19/00*** | (2006.01) |
| ***B67D 3/00*** | (2006.01) |

(52) U.S. Cl.

USPC ..... 222/469; 222/474; 222/484

(58) Field of Classification Search

USPC ..... 222/556, 566, 472, 469, 470, 471, 473, 222/474, 475, 559, 529, 484; 251/144; 137/575

See application file for complete search history.

(56) References Cited

U.S. PATENT DOCUMENTS

| | | | |
|---|---|---|---|
| 1,687,120 | A | 10/1928 | Blanchard |
| 2,172,142 | A | 9/1939 | Lebus |
| 2,335,195 | A | 11/1943 | Packer |
| 3,727,807 | A | 4/1973 | Flider |
| 3,729,122 | A | 4/1973 | Flider |
| 3,729,129 | A | 4/1973 | Fletcher et al. |
| 3,794,235 | A | 2/1974 | Flider |
| 3,811,605 | A | 5/1974 | Flider |
| 3,927,797 | A | 12/1975 | Flider |
| 4,063,667 | A | 12/1977 | Flider |
| 4,065,024 | A | 12/1977 | Atwell |
| 4,138,037 | A | 2/1979 | Zehr |

(Continued)

FOREIGN PATENT DOCUMENTS

WO WO2009/102887 A1 8/2009

OTHER PUBLICATIONS

ISA/US International Search Report and Written Opinion in PCT/US2011/026690, May 5, 2011.

(Continued)

*Primary Examiner* — Kevin P Shaver
*Assistant Examiner* — Stephanie E Williams
(74) *Attorney, Agent, or Firm* — Leydig, Voit & Mayer, Ltd.

(57) ABSTRACT

A safety can includes a receptacle and a valve mechanism connected thereto. The valve mechanism can include a body, a fill cover assembly, a pour valve assembly, and a trigger assembly. The body can include a fill port and a separate pour port. The fill cover assembly can be adapted to selectively move between a closed position to cover the fill port and an open position to allow the receptacle to be filled. The pour valve assembly can be adapted to selectively move between a closed position to cover the pour port and an open position to allow fluid to be poured from the receptacle through the pour port. The trigger assembly can be operated to move the pour valve assembly. The pour valve and the pour port can be disposed along a longitudinal pour axis. The fill port can be disposed in offset relationship to the longitudinal pour axis.

22 Claims, 5 Drawing Sheets

(56) References Cited

U.S. PATENT DOCUMENTS

| | | | |
|---|---|---|---|
| 4,249,563 | A | 2/1981 | Shaw |
| 4,280,679 | A | 7/1981 | Shaw |
| 4,458,711 | A | 7/1984 | Flider |
| 4,460,010 | A | 7/1984 | Paravigna et al. |
| 4,489,860 | A | 12/1984 | Flider |
| 4,491,251 | A | 1/1985 | Pratz et al. |
| 4,492,319 | A | 1/1985 | Cooper |
| 4,529,099 | A | 7/1985 | Zerrer |
| 4,552,288 | A | 11/1985 | Flider |
| 4,597,504 | A | 7/1986 | Witt |
| 4,645,099 | A | 2/1987 | Gillispie et al. |
| 4,662,544 | A | 5/1987 | Gillispie |
| 4,682,627 | A | 7/1987 | Cooper et al. |
| 4,690,308 | A | 9/1987 | Cavanaugh et al. |
| 4,819,794 | A | 4/1989 | Silverstein et al. |
| 4,856,664 | A | 8/1989 | Gillispie et al. |
| 4,881,647 | A | 11/1989 | Schiemann |
| 4,941,403 | A | 7/1990 | Cimenti |
| 4,950,082 | A | 8/1990 | Carlson |
| 4,969,571 | A | 11/1990 | Bartz |
| 4,978,004 | A | 12/1990 | Silverstein et al. |
| 5,056,691 | A | 10/1991 | Tolbert |
| 5,226,574 | A | 7/1993 | Durinzi, Jr. |
| 5,249,693 | A | 10/1993 | Gillispie et al. |
| 5,295,610 | A | 3/1994 | Levison |
| D350,806 | S | 9/1994 | Cooper |
| D358,330 | S | 5/1995 | Kahl |
| 5,462,169 | A | 10/1995 | Dygert et al. |
| 5,485,942 | A | 1/1996 | Foster |
| 5,551,454 | A | 9/1996 | Goncalves |
| 5,553,750 | A | 9/1996 | Foster |
| 5,564,608 | A | 10/1996 | Cooper |
| D376,540 | S | 12/1996 | Boumil |
| 5,597,097 | A | 1/1997 | Morris |
| 5,601,211 | A | 2/1997 | Foster |
| D380,682 | S | 7/1997 | Robinson |
| 5,660,204 | A | 8/1997 | Piotrowski et al. |
| 5,660,292 | A | 8/1997 | Scholfield |
| 5,662,249 | A | 9/1997 | Grosse |
| 5,671,868 | A | 9/1997 | Herr |
| 5,683,007 | A | 11/1997 | Scholfield |
| 5,746,359 | A | 5/1998 | Stanek et al. |
| 5,833,094 | A | 11/1998 | Willis |
| 5,897,021 | A | 4/1999 | Babcock |
| 5,961,006 | A | 10/1999 | Dunham et al. |
| 5,966,743 | A | 10/1999 | Flann |
| 5,967,370 | A | 10/1999 | Nettles et al. |
| 6,003,735 | A | 12/1999 | Strecker |
| 6,006,959 | A | 12/1999 | Naden et al. |
| 6,056,005 | A | 5/2000 | Piotrowski et al. |
| 6,176,474 | B1 | 1/2001 | Stanek et al. |
| 6,196,255 | B1 | 3/2001 | Poillucci |
| 6,244,457 | B1 | 6/2001 | Piotrowski et al. |
| 6,283,320 | B1 | 9/2001 | Patch |
| 6,331,586 | B1 | 12/2001 | Thielen et al. |
| 6,390,153 | B1 | 5/2002 | Flider et al. |
| 6,772,918 | B2 | 8/2004 | Mack, Jr. |
| 7,152,764 | B2 | 12/2006 | Mack, Jr. |
| 2004/0221920 | A1 | 11/2004 | Ferguson et al. |

OTHER PUBLICATIONS

Eagle Manufacturing Company (Wellsburg, West Virginia), internet pages and photographs of various Type-I safety cans, publicly available in the U.S. prior to Oct. 7, 2002, 5 pages.

SAFETY CAN

CROSS REFERENCE TO RELATED APPLICATIONS

This application claims the benefit of priority to U.S. Provisional Patent Application No. 61/309,345, filed on Mar. 1, 2010, and entitled, "Safety Can," which is incorporated in its entirety herein by this reference.

TECHNICAL FIELD

The present disclosure relates in general to a safety container for storing and dispensing flammable fluids, and in particular to a safety container that includes a valve assembly with a pour spout, a fill spout, and a venting system.

BACKGROUND

The disclosure relates to safety cans or containers for holding fluids and especially, although not exclusively, to containers for flammable fluids such as gasoline, oil, diesel, kerosene and the like. In general, these safety containers may be one of two types. The first type is commonly referred to as a Type I can. The Type I can is a container with one spout through which both filling and pouring are accomplished.

The Type I can is typically used in applications where liquid is to be poured from the can into a container having a wider opening than the opening of the Type I can. In instances where the receiving container has an opening that is smaller than the opening of the safety can, a hinged funnel attachment can be installed on the safety can to prevent spillage during the filling operation. The Type I can may be inconvenient to use in the latter situation because it can be burdensome to place the funnel attachment in line with the spout when pouring from the can, move the funnel away from the spout when filling the can, and then return the funnel over the spout for pouring again.

The second type is commonly referred to as a Type II can. The Type II can is a container with two separate spout openings, one used to fill the can and the other used to pour therefrom. Typically, there is a hose associated with the pouring spout to allow pouring into a small opening. Also, a Type II can includes a venting feature.

A Type II can is more convenient to pour from than a Type I can because the Type II can may include an attached hose that does not need to be detached when the can is being filled. However, the Type II can of the prior art is often more expensive to produce than the Type I can because of the necessity of providing two spouts, for example. Furthermore, the mechanisms for operating the dual spouts can be complicated and difficult to use. Examples of such safety cans include those shown and described in U.S. Pat. Nos. 6,390,153; 6,772,918; and 7,152,764, which are incorporated in their entireties herein by reference.

BRIEF SUMMARY OF THE DISCLOSURE

The present disclosure is generally directed toward providing a safety can with a Type II configuration. In one aspect, the disclosure provides a can for storing and dispensing liquids. The can includes a receptacle and a valve assembly connected to the receptacle. The receptacle defines an inner chamber and includes an outer surface defining a main opening in fluid communication with the inner chamber. The valve assembly includes a valve body, a fill cap, and a pour valve. The valve body defines a fill opening, a pour opening, a main passage, and a pouring valve passage. The main passage extends along a main passage centerline between the fill opening and a main passage opening. The main passage opening is aligned and fluidly open to the main opening of the receptacle such that the main passage and the inner chamber are fluidly connected. The pouring valve passage extends along a pouring valve passage centerline and is in communication with the pour opening. The valve body defines at least one fluid passage fluidly interconnecting the main passage and the pour opening. The main passage centerline is substantially perpendicular to the pouring valve passage centerline. The main passage centerline is disposed at an offset distance, D, from the pouring valve passage centerline along an axis that is perpendicular to the pouring valve passage centerline. The fill cap is adapted to selectively cover the fill opening. The pour valve is movably disposed within the pouring valve passage over a range of travel between a closed position and an open position. The pour valve is adapted to fluidly block the pour opening when the pour valve is in the closed position.

In another aspect, the disclosure describes a valve assembly for a Type II fluid receptacle having an inner chamber suitable for storage and dispensing of flammable liquids. The valve assembly includes a valve body, a fill cap, and a pour valve. The valve body defines a fill opening, a pour opening, a main passage, and a pouring valve passage. The main passage extends along a main passage centerline between the fill opening and a main passage opening. The pouring valve passage extends along a pouring valve passage centerline and is in communication with the pour opening. The valve body defines at least one fluid passage fluidly interconnecting the main passage and the pour opening. The main passage centerline is substantially perpendicular to the pouring valve passage centerline. The main passage centerline is disposed at an offset distance, D, from the pouring valve passage centerline along an axis that is perpendicular to the pouring valve passage centerline. The fill cap is adapted to selectively cover the fill opening. The pour valve is movably disposed within the pouring valve passage over a range of travel between a closed position and an open position. The pour valve is adapted to fluidly block the pour opening when the pour valve is in the closed position.

DETAILED DESCRIPTION OF THE DRAWINGS

Figure 1:
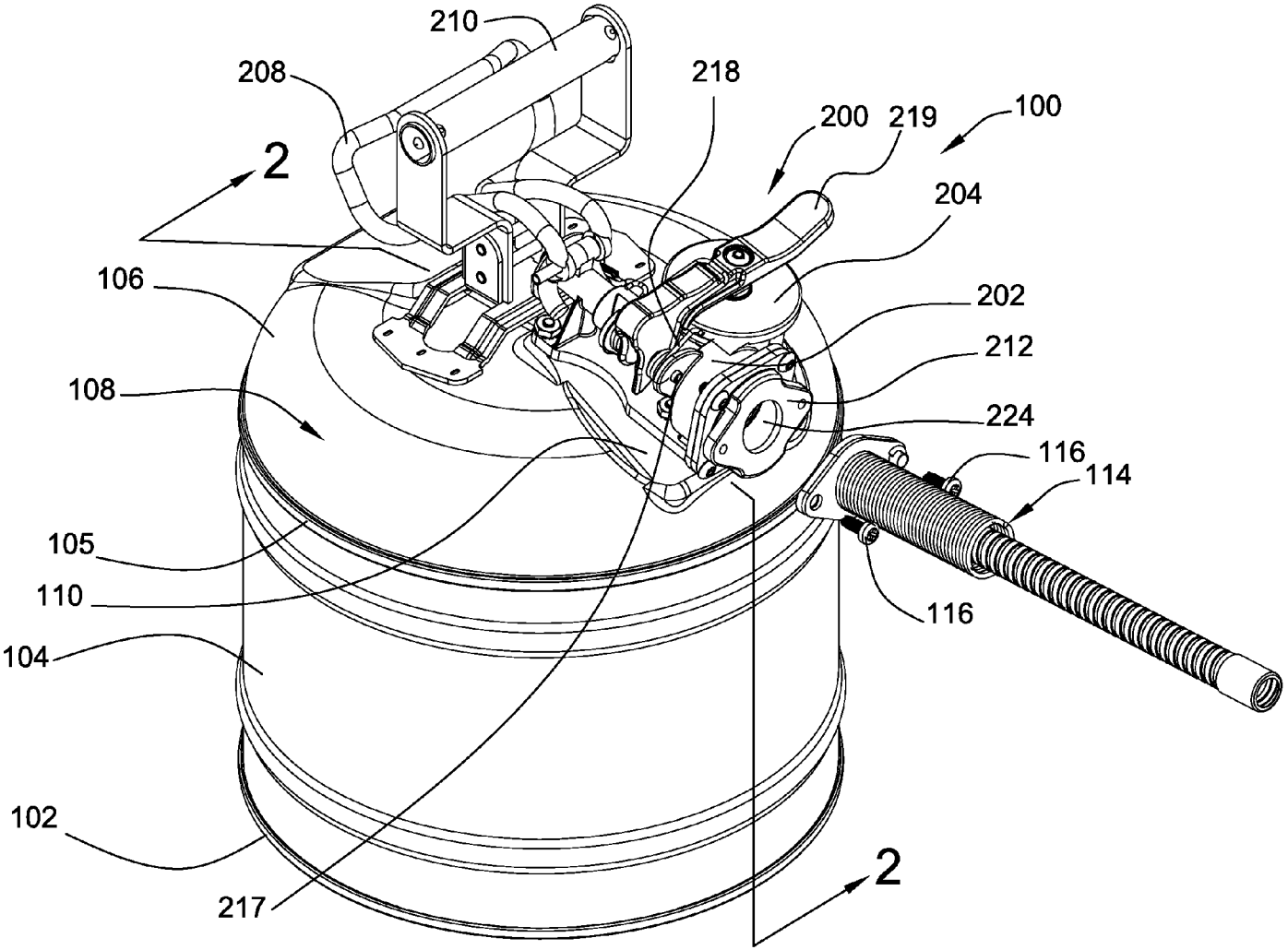
FIG. 1 is a perspective view of an embodiment of a safety can constructed in accordance with principles of the disclosure, a flexible metal hose being shown in a detached position for illustrative purposes.

In accordance with principles of the present disclosure, there is provided a safety can for storing flammable liquid such as gasoline, diesel fuel, and the like. The safety can includes a receptacle and a valve assembly having a fill port and a separate pour port. In the illustrated embodiments, the valve assembly includes an ergonomic trigger mechanism to operate a pour valve and a flip-top cover assembly to selectively open and close the fill port. The trigger is operated to actuate the pour valve assembly to pour liquid from the can when the trigger is moved away from the receptacle. A flip-top lever is moved to open a fill cover of the fill cover assembly to allow the fill port to be accessible. After a desired amount of fluid is conveyed into the receptacle via the fill port, the lever is released to automatically close the fill cover which is biased to the closed position via a spring. The fill port and the pour port are disposed in offset relationship to each other relative to a longitudinal pour axis which is substantially parallel to the line of action of the pour valve assembly.

The safety can of the present disclosure can include an integral automatic venting system to facilitate pouring liquid from the can. The venting system is linked to the pour valve actuation system.

In some embodiments, a safety can of the present disclosure can be used to store flammable liquids, such as, gasoline, diesel fuel, and the like, for example, and includes a valve mechanism that provides a Type II configuration with a pair of ports, a fill port and a pour port or spout. Both spouts can be equipped with flame arrestors to help dissipate heat to inhibit flashback ignition. The safety can includes a trigger assembly for convenient operation of the pour spout. The trigger can be positioned to pour from the can and to place the container in a safety position.

In some embodiments, the safety can includes a receptacle and a valve mechanism that has a body assembly, a fill cover assembly, a pour valve assembly, and a trigger assembly. The body assembly of the valve mechanism can be mounted to the receptacle. The body assembly can include a fill port and a separate pour port. The fill cover assembly can be pivotally mounted to the body assembly about a fill cover axis. The pour valve assembly can be movably mounted to the body assembly and be disposed therein.

The trigger assembly can be pivotally mounted to the body assembly about a trigger axis. The trigger assembly can be operably engaged with the pour valve assembly for selective movement of the pour valve assembly between a closed position and an open position. Moving the trigger away from the receptacle can move the pour valve assembly from the closed position to the open position. The pour valve and the pour port are disposed along a longitudinal pour axis of the valve mechanism, and the fill port is disposed in offset relationship to the longitudinal pour axis.

In some embodiments, the safety can includes an integral automatic venting system to facilitate pouring liquid from the can. The venting system can be linked to the pour valve actuation system. The venting system can resist venting as a result of increased pressure build up within the can. Pressure build up can be vented through the fill cover assembly in the event such pressure rises above a predetermined value to help guard against pressure buildup at elevated temperatures and help avoid potential explosion.

A handle can be mounted to the body assembly. A flexible metal hose can be mounted to the body assembly to facilitate the dispensing of liquid from the safety can and to provide a bonding path to a receiving vessel.

In some embodiments, the safety container of the present disclosure can include a cage to protect the valve assembly. A clamp can be mounted to the fill cover assembly to provide an additional safety feature. The clamp can include a thumbscrew for selectively engaging the fill cover to secure the clamp thereto. The clamp can be pivoted out of the way when not in use. The clamp can include a fusible link configured to sever upon reaching a predetermined temperature.

Figure 2:
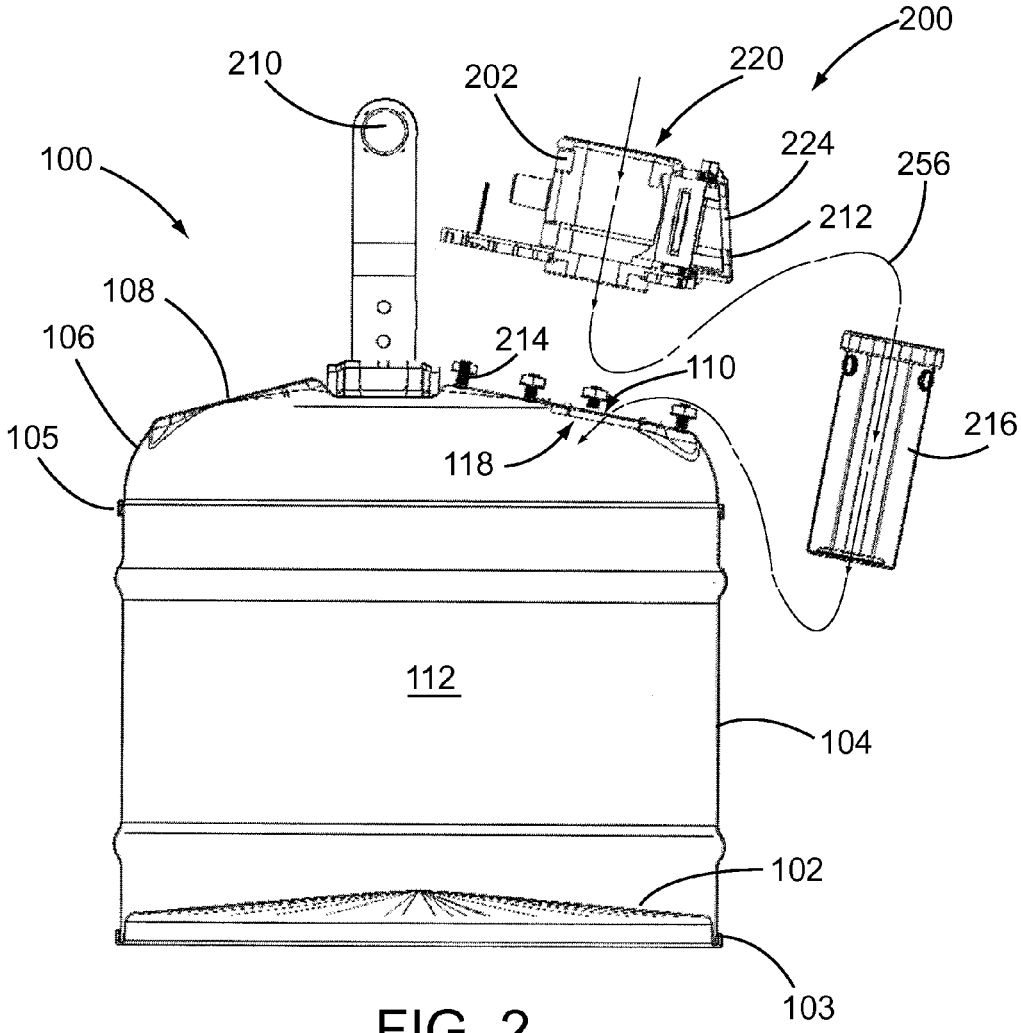
FIG. 2 is a partial exploded view of the safety can of FIG. 1 with some components shown in section taken along line 2-2 in FIG. 1.

Turning now to the Figures, an illustrative safety can is shown in the drawings that includes a receptacle and a valve assembly mounted thereto. Although a particular embodiment for a safety can is shown, variations for different can fluid capacities and/or additional features are contemplated. An outline view of a safety container or can 100 in accordance with the present disclosure is shown in FIG. 1, and an exploded cross section thereof is shown in FIG. 2. Certain components of the valve assembly 200 have been removed from the illustration of FIG. 2 for simplicity.

The can 100 is adapted to store and dispense liquids, such as gasoline, oil, diesel, kerosene, solvents and the like, and may be color-coded depending on the type of fluid carried. The can 100 can be adapted to carry various capacities of fluid, the most common of which being one, three or five gallon capacities for imperial or U.S. systems of fluid volume measurement.

Figure 4:
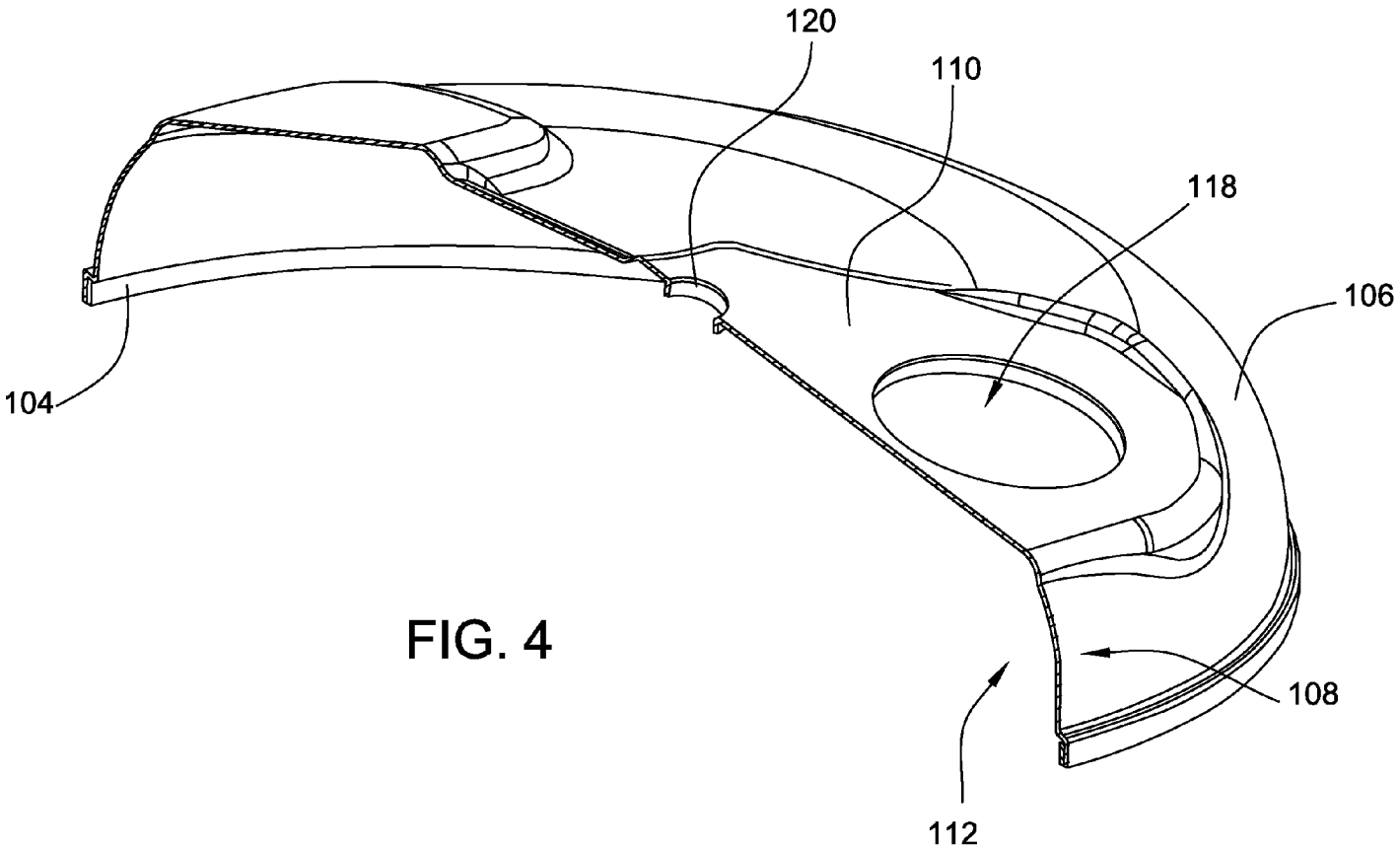
FIG. 4 is a perspective view, in section, of a dome of the safety can of FIG. 1.

Referring to FIGS. 1 and 2, the can 100 includes a base 102, a side wall portion 104 and a dome 106. The base 102 has a generally circular shape that is substantially planar along its outer periphery. The side wall portion 104 is generally cylindrical and connected peripherally around the base 102 at one end thereof along a fluid-tight seam 103. The dome 106 presents a convex outer surface 108 that includes a generally flat portion 110 for receiving a valve assembly 200 (shown in, e.g., FIG. 4). The dome 106 is connected at the second open end of the cylindrical side wall portion 104 along a fluid-tight seam 105 to provide an enclosed, sealed fluid receptacle of the can 100. The base 102, side wall portion 104, and dome 106 are connected in this way to define an inner chamber 112 (FIG. 2) for holding fluid. The various components of the receptacle of the can 100 may be made from any suitable material, such as steel or another suitable metal, for example, that is stamped, forged, pressed or otherwise formed into a desired shape.

Figure 3:
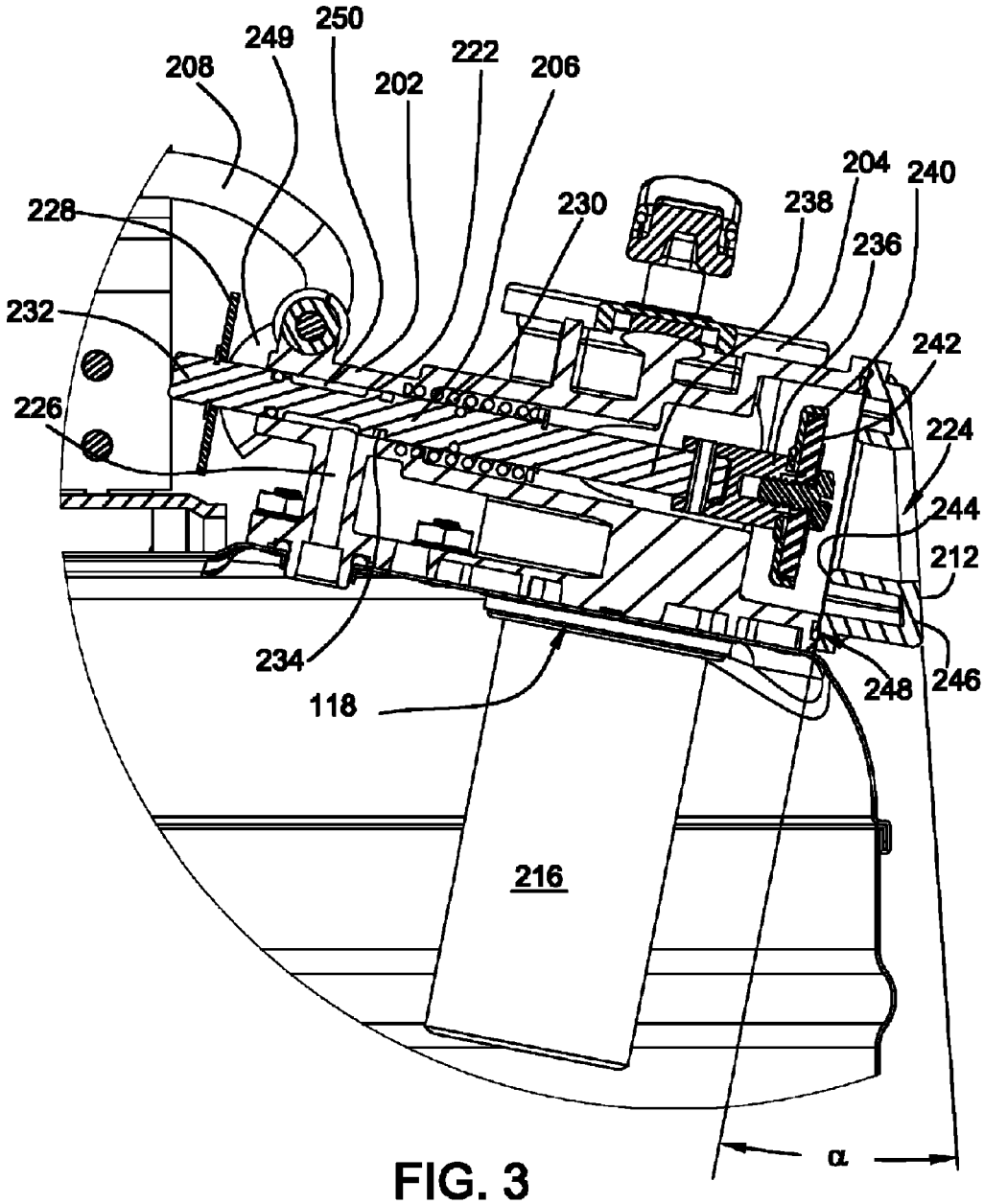
FIG. 3 is an enlarged, fragmentary elevational view, in section, of a valve assembly of the safety can of FIG. 1.

The valve assembly 200 provides the can 100 with a Type II configuration. As shown in FIGS. 1, 2 and 3, the valve assembly 200 includes a body 202, a fill cover 204 (not shown in FIG. 2), a pour valve assembly 206, and a trigger assembly 208 (not shown in FIG. 2). As shown in FIG. 1, a handle 210 can be attached to the dome 106 to facilitate the transport of the safety can 100. In some embodiments, the handle 210 can be a swinging-type handle that includes a gripping portion that is pivotally movable with respect to the dome 106 to facilitate carrying a full can 100. A flexible metal hose 114 is connectable by screws 116 to a flange 212 of the body 202 to facilitate the dispensing of liquid from the can 100.

Referring to FIGS. 1 and 2, the body 202 of the valve assembly 200 is mounted to the flat portion 110 of the outer surface 108 of the dome 106 in a fluid-tight fashion by use of fasteners 214 (four shown in FIG. 2). A flame arrestor 216 is disposed between the valve body 202 and a main opening 118 of the dome 106, which fluidly connects the inner chamber 112 with the valve assembly 200.

In the illustrated embodiment, the fill cover 204 is pivotally connected to the body 202 at a pivot 217 such that the fill cover 204 is movable over a range of travel between a closed position, wherein the fill port is occluded, and an open position, wherein a fill port 220 is accessible to allow the receptacle to be filled. The pivot 217 includes a resilient biasing element or spring 218 that biases the fill cover 204 against the fill opening 220 of the valve body 202. The cover spring 218 acts upon a cover operating lever 219 which in turn acts to place the fill cover gasket in sealing engagement with the fill port 220 of the body 202. In the illustrated embodiment, the resilience of the spring 218 is selected to permit venting of the inner chamber 112 through the fill opening 220 when fluid or vapor pressure in the inner chamber 112 exceeds a predetermined pressure, for example, 3 or 5 psi.

When in a fill position, the fill cover 204 has moved in an opening direction about the pivot 217 to an open position. The fill port 220 can be accessed to fill the receptacle. Continued application of force on the cover operating lever 219 maintains the fill port 220 in an open position. When the operating lever 219 is released or allowed to return, the cover spring 218 acts to close the fill port 220.

When the fill cover 204 is in the open position, the atmosphere inside the receptacle is open to the outside atmosphere through the fill port 220 alone which can allow for efficient and clean filling of the receptacle therethrough with a pour port 224 of the valve body 202 sealed.

In reference to FIG. 3, the pour valve assembly 206 is movably mounted within a pouring valve passage 222 of the valve body 202 and is adapted to selectively seal the pour opening 224 of the valve body 202 and a venting passage 226 of the valve body 202. The pour valve assembly 206 is selectively movable over a range of travel between a closed position, wherein the pour valve assembly 206 seals the pour opening 224, and one of a range of pour positions, wherein the pour valve assembly is disengaged from the pour opening 206 such that fluid stored within the receptacle can flow past the pour valve assembly 206 and out the pour opening 224.

In the illustrated embodiment, the pour valve assembly includes an actuator 228, a pour valve spring 230, a slide shaft 232, a pair of shaft O-rings 234, a pivot segment 236, a slotted spring pin 238, a valve cup 240, a pour valve gasket 242, and a pour spout seat 244, which is formed on the body 202 in the illustrated embodiment but which may alternatively be a separate part connected to the body 202.

An angled outlet flange 246 is connected to a face 248 of the body and forms the outlet flange 212. As shown, an angle, $\alpha$ (alpha), is defined between two opposing faces of the angled outlet flange 246. The angle $\alpha$ can be any suitable angle. For example, in some embodiments, the angle $\alpha$ can be no greater than 90°. In yet other embodiments, the angle $\alpha$ can be no greater than 45°.

The pour valve assembly 206 is shown in an open, pour position in FIG. 3. During operation, when the pour valve assembly 206 is in the closed position, the slide shaft 232 and the other components connected therewith are adapted to press the gasket 242 against the pour spout seat 244 by force of the spring 230. A cam feature 249 of the pivotable trigger 208 pushes against the washer-shaped actuator 228 that is connected at one end of the slide shaft 232 such that the slide shaft 232 and the other components connected thereto move, in response to movement of the cam feature 249 by operation of the trigger 208, within the pouring valve passage 222 while also compressing the spring 230. In this way, the gasket 242 is lifted from the pour spout seat 244 and a fluid path is opened between the inner chamber 112 and the pour opening 224. When the trigger 208 is released, the slide shaft 232 and all components connected thereto are pushed by the spring 230 back toward the closed position.

The pouring valve passage 222 of the body 202 includes a narrowed portion that aligns with a channel 250 of the slide shaft 232 when the pour valve assembly 206 is in an open position. The pouring valve passage 222 is fluidly connected to the inner chamber 112 of the can 100 through a vent opening 120 in the dome 106 (see FIG. 4). The channel 250 is fluidly connected to the environment via a body opening (not shown) or, as shown, by sufficiently retracting the slide shaft 232 from the body 202 such that a portion of the channel 250 is exposed. Venting of the inner chamber 112 is provided for the smooth flow of liquid during pouring.

Although the can 100 is functionally similar to the safety receptacle described in U.S. Pat. No. 7,152,764 (the '764 patent), the valve body 202 includes structural differences over prior designs that help its function, manufacturability and service life as is hereinafter described. In the device described in the '746 patent and shown, for example, in FIG. 5 thereof, the valve body forms fill and pour passages having orthogonally intersecting centerlines. In one method of manufacturing this structural configuration, a stirrup ring is used at the intersection of the two passages. Due to their shape, some stirrup rings tend to deform at high temperatures, such as those used to braze components together or bake the paint or other coatings applied to the valve during manufacturing. For this reason, it may become necessary to defer installation of the ring until after the high temperature process, or inspect and rework receptacles at the end of the line. Moreover, the coplanar centerlines of the fill and pour passages may result in wetting of the fill cover with fluid being poured, especially when the receptacle is tilted during pouring. The valve assembly 200 of the presently disclosed embodiments is adapted to avoid these and other considerations.

Figure 5:
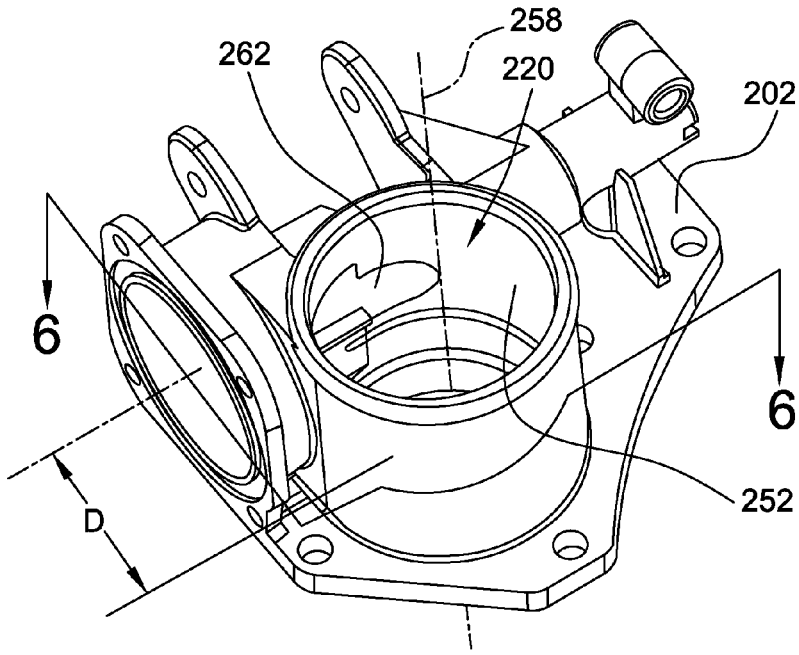
FIG. 5 is a perspective view of an embodiment of a valve body constructed in accordance with principles of the disclosure.
Figure 6:
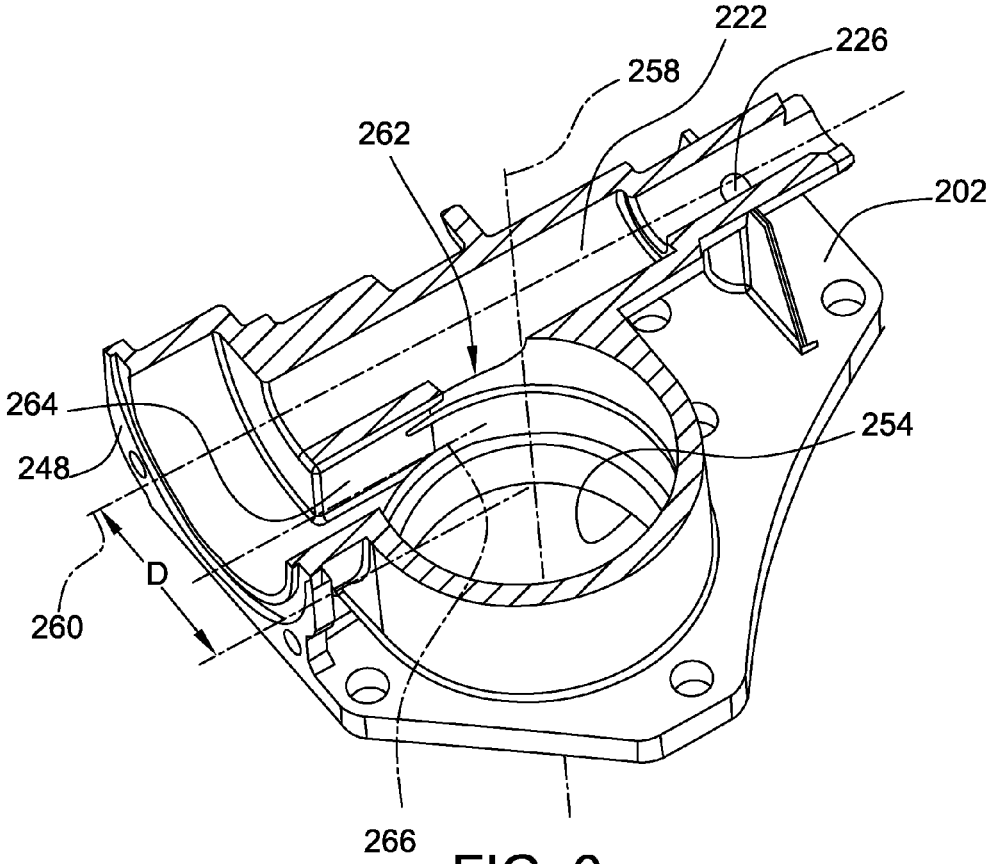
FIG. 6 is a cross-sectional view of the valve body taken along line 6-6 in FIG. 5.

A perspective view of the valve body 202 is shown in FIG. 5 and a cross section thereof is shown in FIG. 6. The valve body 202 may be made of metal by any suitable process, such as fabrication or casting. In the illustrated embodiment, the valve body 202 is made of investment cast or die cast zinc. The valve body 202 includes the fill opening 220 that is defined at the end of a main passage 252. The main passage 252 extends through the valve body 202 and forms a tank opening 254 at an end opposite the fill opening 220. When the valve body 202 is installed onto the dome 106, the tank opening 254 is substantially aligned with the main opening 118 (FIG. 4) such that the inner chamber 112 and the main passage 252 are fluidly interconnected. When the inner chamber 112 is filled with fluid, fluid is dispensed into the main passage 252 through the fill opening 220 before passing into the inner chamber 112 through the main opening 118 and, optionally the flame arrestor 216, following a fill path 256, which is denoted in FIG. 2 by open headed arrows.

The main passage 252 has a generally cylindrical shape having a centerline 258. The pouring valve passage 222 of the valve body 202, which slidably accepts the pour valve assembly 206 as shown in FIG. 3 and previously described, has a generally stepped cylindrical shape having a centerline 260. The centerline 258 of the main passage 252 is disposed generally perpendicularly relative to the centerline 260 of the pouring valve passage 222. However, the centerlines 258, 260 of the main passage 252 and the pouring valve passage 222 do not intersect but rather are disposed at an offset distance, D, from one another taken along an axis that is perpendicular to the centerline 260 of the pouring valve passage 222 and to the centerline 258 of the main passage 252. In the illustrated embodiment, the distance D is less than the sum of the radii of the main passage 252 and the pouring valve passage 222 at the point where these two bores intersect. As shown, an opening 262 is formed in the body 202 between and fluidly interconnects the main passage 252 and the pouring valve passage 222. Although the distance D in the illustrated embodiment is less than the sum of the radii of the intersecting bore sections, it can alternatively be equal to or larger than that sum. In such alternative embodiments, the opening 262 may have an elongate shape.

When liquid is poured from the inner chamber 112, fluid passes through the flame arrestor 216 and enters the main passage 252. From the main passage 252, the fill opening 220 of which is blocked during pouring by the fill cover 204 (shown in FIG. 1), fluid passes into the pouring valve passage 222 through the opening 262. When the pour valve assembly 206 is in the open position, as previously described and as shown in cross section in FIG. 3, fluid from the pouring valve passage is free to pour out of the pour opening 224 and through the hose 114 if one is present. As can be appreciated, the flow area of the opening 262 and that of the bores and openings formed in the valve body 202 may determine the flow rate of poured liquid. So as to provide sufficient flow area for pouring liquids, the valve body 202 further includes a second pour passage 264 that is adapted to fluidly interconnect the main passage 252 with the pouring valve passage 222. As shown, the second pour passage 264 has a generally rectangular cross section having a centerline 266 that extends substantially parallel to the centerline 260 of the pouring valve passage 222 and generally tangentially relative to the circular cross section of the main passage 252. The second pour passage 264 is in fluid communication with the pour opening 224. The fluid path established from the inner chamber 112 and the second pour passage 264 is thus similarly selectively occluded by the pour valve assembly 206.

Other features and elements may be used with the can 100, that can facilitate its use. For example, as described in more detail in the '764 patent, bars may be used to protect the top of the can 100 and the valve assembly 200 from impact. Further, a clamp may be used that secures the fill cover 204 with a thumbscrew to prevent unintentional opening. Such clamp assembly can include a thumbscrew, a cover hold-down bracket, a pair of fusible links, and a pair of S-hooks. The cover hold-down bracket may further include a threaded opening therein to retain the thumbscrew and a pair of tabs for respectively mounting fusible links thereto about a first opening thereof. One end, S-hooks can be respectively attached to the fusible links by operative engagement with a second opening of the fusible links. The mounting plate can include a pair of ears for respectively securing the other end of the S-hooks thereto. Each fusible link can be made from a plurality of portions that are soldered together, for example. The fusible links can be constructed such that they will fuse when the ambient temperature is above a selected temperature, 165° F., for example, to thereby sever the link such that the clamp assembly is detached.

The clamp assembly can be fixed in position with the thumbscrew secured against the tip of the post extending from the fill cover to prevent the trigger from being able to move the fill cover assembly to the open position, for facilitating safe transportation of the safety can, for example. The trigger can be operated to place the valve assembly in a pour position with the clamp assembly mounted to the fill cover assembly.

When not in use, the clamp assembly can be rotated about the ears of the mounting plate to thereby reduce the risk of loss or damage to the clamp assembly and to facilitate its use. The clamp assembly can be rotated to a stored position wherein the thumbscrew is set such that it is retained in a dimple of the seat. The trigger can be operated in the normal fashion to move the valve cover assembly to an open position.

In other embodiments, a safety can according to principles of the present disclosure can be similar in some respects, construction and features to the safety containers disclosed in U.S. Pat. Nos. 6,390,153; 6,772,918; and 7,152,764, said patents being incorporated herein in their entireties by this reference.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A can for storing and dispensing liquids, comprising:

a receptacle defining an inner chamber, the receptacle including an outer surface defining a main opening in fluid communication with the inner chamber; and a valve assembly connected to the receptacle, the valve assembly including:

a valve body, the valve body defining a fill opening, a pour opening, a main passage, and a pouring valve passage, the main passage extending along a main passage centerline between the fill opening and a main passage opening, the main passage opening being aligned and fluidly open to the main opening of the receptacle such that the main passage and the inner chamber are fluidly connected, the pouring valve passage extending along a pouring valve passage centerline, the pouring valve passage in communication with the pour opening, the valve body defining at least one fluid passage fluidly interconnecting the main passage and the pour opening, wherein the main passage centerline is substantially perpendicular to the pouring valve passage centerline, and wherein the main passage centerline is disposed at an offset distance, D, from the pouring valve passage centerline along an axis that is perpendicular to the pouring valve passage centerline, a fill cap adapted to selectively cover the fill opening, and a pour valve movably disposed within the pouring valve passage over a range of travel between a closed position and an open position, the pour valve adapted to fluidly block the pour opening when the pour valve is in the closed position.

2. The can of claim 1, wherein the main passage has a generally cylindrical shape and wherein the pouring valve passage has a stepped cylindrical shape.

3. The can of claim 1, further comprising a resilient element disposed to bias the fill cap toward sealing engagement with the fill opening.

4. The can of claim 1, wherein the valve body defines a pour valve seat adjacent the pour opening, and the pour valve includes a slide shaft, an actuator adapted to selectively move the slide shaft in the pouring valve passage, a pour valve gasket disposed to sealingly engage the pour valve seat of the valve body when the pour valve is in the closed position, and a spring in engaging relationship with the slide shaft and adapted to bias the pour valve to the closed position.

5. The can of claim 4, further comprising a movable trigger having a cam feature adapted to move the slide shaft when the trigger is actuated such that the pour valve gasket is unseated from the pour valve seat.

6. The can of claim 1, further comprising an angled outlet flange connected to a face of the body that surrounds the pour opening.

7. The can of claim 6, wherein the angled flange forms an outlet flange disposed at an acute angle relative to the face of the body that surrounds the pour opening.

8. The can of claim 7, wherein the acute angle is about 45-degrees.

9. The can of claim 1, wherein the fluid receptacle includes a base, a cylindrical side wall portion and a dome, the base, the side wall portion and the dome being connected in a fluid-tight fashion to define the inner chamber therebetween.

10. The can of claim 9, wherein the dome includes a convex outer surface that includes the surface onto which the valve body is connected.

11. The can of claim 1, wherein the valve body defines a vent passage fluidly connected to a vent opening of the fluid receptacle such that the vent passage is fluidly connected to the inner chamber when the pour valve is in an open position.

12. The can of claim 1, wherein the valve body is made of metal using a fabrication or molding operation.

13. The can of claim 1, wherein the valve body defines a second passage adapted to fluidly interconnect the main passage and the pour opening.

14. The can of claim 13, wherein the second passage has a generally rectangular cross section and extends along a centerline in substantially parallel relationship to the pouring valve passage centerline and tangentially relative to a main passage cross section.

15. A valve assembly for a Type II fluid receptacle having an inner chamber suitable for storage of flammable liquids, the valve assembly comprising:

a valve body, the valve body defining a fill opening, a pour opening, a main passage, and a pouring valve passage, the main passage extending along a main passage centerline between the fill opening and a main passage opening, the pouring valve passage extending along a pouring valve passage centerline, the pouring valve passage in communication with the pour opening, the valve body defining at least one fluid passage fluidly interconnecting the main passage and the pour opening, wherein the main passage centerline is substantially perpendicular to the pouring valve passage centerline, and wherein the main passage centerline is disposed at an offset distance, D, from the pouring valve passage centerline along an axis that is perpendicular to the pouring valve passage centerline, a fill cap adapted to selectively cover the fill opening, and a pour valve movably disposed within the pouring valve passage over a range of travel between a closed position and an open position, the pour valve adapted to fluidly block the pour opening when the pour valve is in the closed position.

16. The valve assembly of claim 15, wherein the main passage has a generally cylindrical shape and wherein the pouring valve passage has a stepped cylindrical shape.

17. The valve assembly of claim 15, further comprising a resilient element disposed to bias the fill cap toward sealing engagement with the fill opening.

18. The valve assembly of claim 15, wherein the valve body defines a pour valve seat adjacent the pour opening, and the pour valve includes a slide shaft, an actuator adapted to selectively move the slide shaft in the pouring valve passage, a pour valve gasket disposed to sealingly engage the pour valve seat of the valve body when the pour valve is in the closed position, and a spring in engaging relationship with the slide shaft and adapted to bias the pour valve to the closed position.

19. The valve assembly of claim 18, further comprising a movable trigger having a cam feature adapted to move the slide shaft when the trigger is actuated such that the pour valve gasket is unseated from the pour valve seat.

20. The valve assembly of claim 15, wherein the valve body defines a vent passage.

21. The valve assembly of claim 15, wherein the valve body defines a second passage adapted to fluidly interconnect the main passage and the pour opening.

22. The valve assembly of claim 21, wherein the second passage has a generally rectangular cross section and extends along a centerline in substantially parallel relationship to the pouring valve passage centerline and tangentially relative to a main passage cross section.

* * * * *